US005313756A

United States Patent [19]

Ways et al.

[11] Patent Number: 5,313,756

[45] Date of Patent: May 24, 1994

[54] SUN DECK AND FRAME THEREFOR

[76] Inventors: Bill Ways, 24 Harjolyn Drive, Etobicoke, Ontario, Canada, M9B 3T9; Lancelot Obery, 152 Morton Way, Brampton, Ontario, Canada, L6Y 2P8

[21] Appl. No.: 952,816

[22] Filed: Sep. 28, 1992

[51] Int. Cl.[5] ..... E04B 1/00

[52] U.S. Cl. ..... 52/263; 52/87; 52/651.05; 404/35

[58] Field of Search ..... 52/87, 126.1-126.6, 52/127.8, 263, 93.1, 653.1, 588, 581, 651.05, 651.1; 404/41, 43, 35

[56] References Cited

U.S. PATENT DOCUMENTS 1,045,219 11/1912 Tramill .
1,350,478 8/1920 Staffard ..... 52/92.3
2,033,404 3/1936 Tramill .
2,132,767 11/1938 Betcone ..... 52/584
2,438,604 3/1948 Gogerty ..... 52/263
3,611,655 11/1969 Loebner ..... 52/588
4,289,420 9/1981 Davis et al. ..... 404/35
4,622,792 11/1986 Betts ..... 52/263
4,677,806 7/1987 Tuomi ..... 52/656.1
4,823,529 4/1989 Canfield et al. ..... 52/263

*Primary Examiner*—Carl D. Friedman
*Assistant Examiner*—Winnie Yip
*Attorney, Agent, or Firm*—Ridout & Maybee

[57] ABSTRACT

A prefabricated modular sun deck is disclosed, comprising a floor seated on a frame and preferably including a railing. The deck is easily erected and disassembled into modular sections capable of transport. The frame includes a levelling feature which facilitates levelling of the deck when erected, and periodic relevelling as required, without the need for sunken piers or other permanent supports.

11 Claims, 7 Drawing Sheets

SUN DECK AND FRAME THEREFOR

FIELD OF THE INVENTION

This invention relates to outdoor deck structures. In particular, this invention relates to a prefabricated modular sun deck and a frame therefor.

BACKGROUND OF THE INVENTION

An outdoor deck structure, commonly known as a sun deck, is a popular extension to the living space offered by residential housing and the like. Sun decks can be virtually any size and shape and are conventionally constructed out of weather resistant lumber, either attached to or detached from the main structure. Myriad styles and finishes are known, but virtually all ground-supported sun decks are subject to the limitation that they are permanent structures.

This limitation arises because of the practical considerations involved in constructing any type of living space, the main ones being the load that the structure must bear and the ability to resist shifting of the ground underneath the structure. The latter consideration is particularly important if the deck is to retain its integrity and a level orientation, since the ground underneath a structure shifts unevenly and often substantially from year to year. Conventional construction techniques utilize concrete piers sunk four feet or more to stable ground. However, the permanence of such a structure poses a considerable disadvantage to those living in some kind of mobile abode, such as a trailer or mobile home. There is little incentive to construct a permanent deck where eventual relocation of the main living space is likely, especially on land owned by another such as a trailer park.

The present invention overcomes this disadvantage by providing a prefabricated modular sun deck mounted on an adjustable frame. The deck is easily erected and disassembled into modular sections capable of transport, and the frame facilitates levelling of the deck when erected and periodic relevelling as the supporting ground shifts, without the need for sunken piers or other permanent supports. The deck frame according to the invention is designed to facilitate levelling by a single person, and is also suitable for use as a supporting frame for a permanent deck.

SUMMARY OF THE INVENTION

The present invention thus provides a deck structure comprising a floor comprising at least one floor section, having floorboards secured to orthogonal joists, and a supporting frame including legs supporting a beam, the beam comprising a pair of opposed boards with an adjustable gap therebetween.

The present invention further provides a frame for a deck structure comprising supporting legs and a supporting beam comprising a pair of opposed boards connected by securing means with a gap between the boards sufficient to enable the legs to be disposed therein, wherein when a leg is disposed in the gap adjacent to the securing means the securing means can be tightened such that the leg is frictionally engaged between the boards and the level of the beam relative to the leg can thereby be adjusted by the application of force sufficient to overcome the frictional engagement of the leg by the beam.

BRIEF DESCRIPTION OF THE DRAWINGS

In drawings which illustrate by way of example only a preferred embodiment of the present invention.

DETAILED DESCRIPTION OF THE INVENTION

A preferred embodiment of the sun deck of the present invention consists of a floor 10 supported on a supporting frame 20 with a railing 30. Preferred lumber dimensions are provided, but the invention is not restricted to any particular size of lumber. Those skilled in the art will be familiar with the minimum lumber dimensions required and local building code requirements for the various components of the deck. It will further be apparent that although the preferred embodiment is described as composed of wood, the invention is not so restricted and includes wood substitutes such as plastic and the like.

Figure 1:
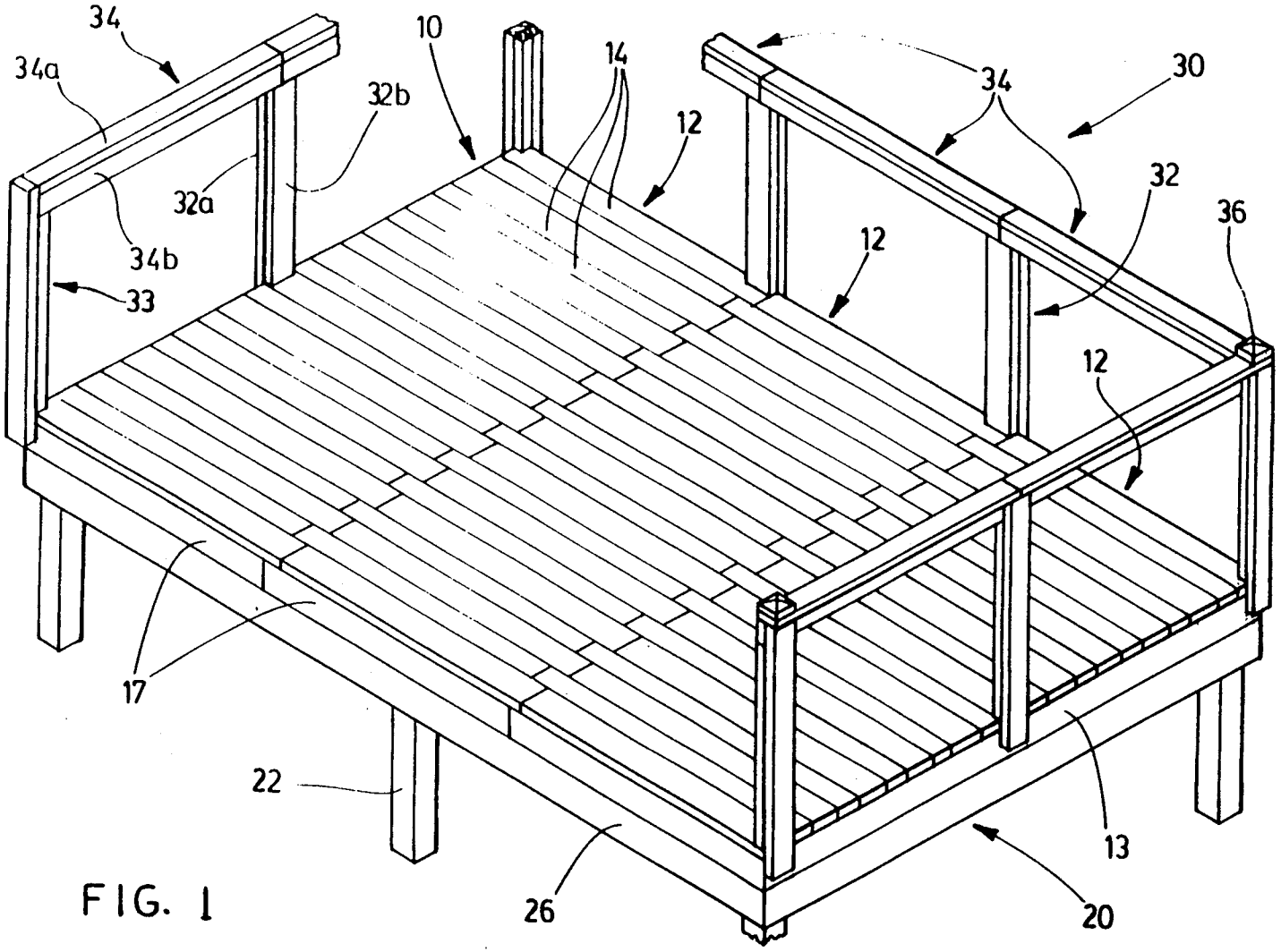
FIG. 1 is a perspective view of the deck embodying the present invention.
Figure 2:
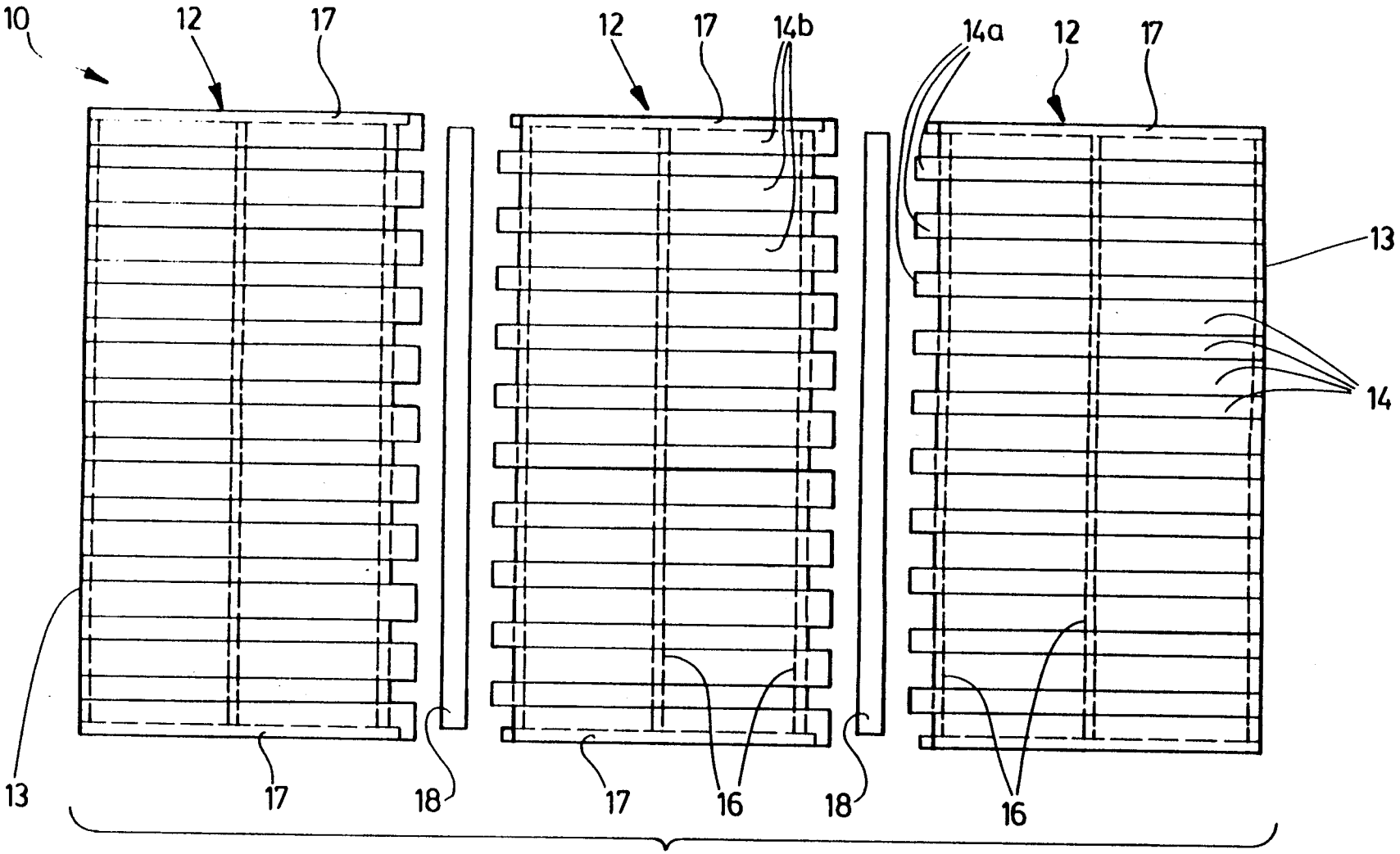
FIG. 2 is a partially exploded top plan view of the deck floor.
Figure 3:
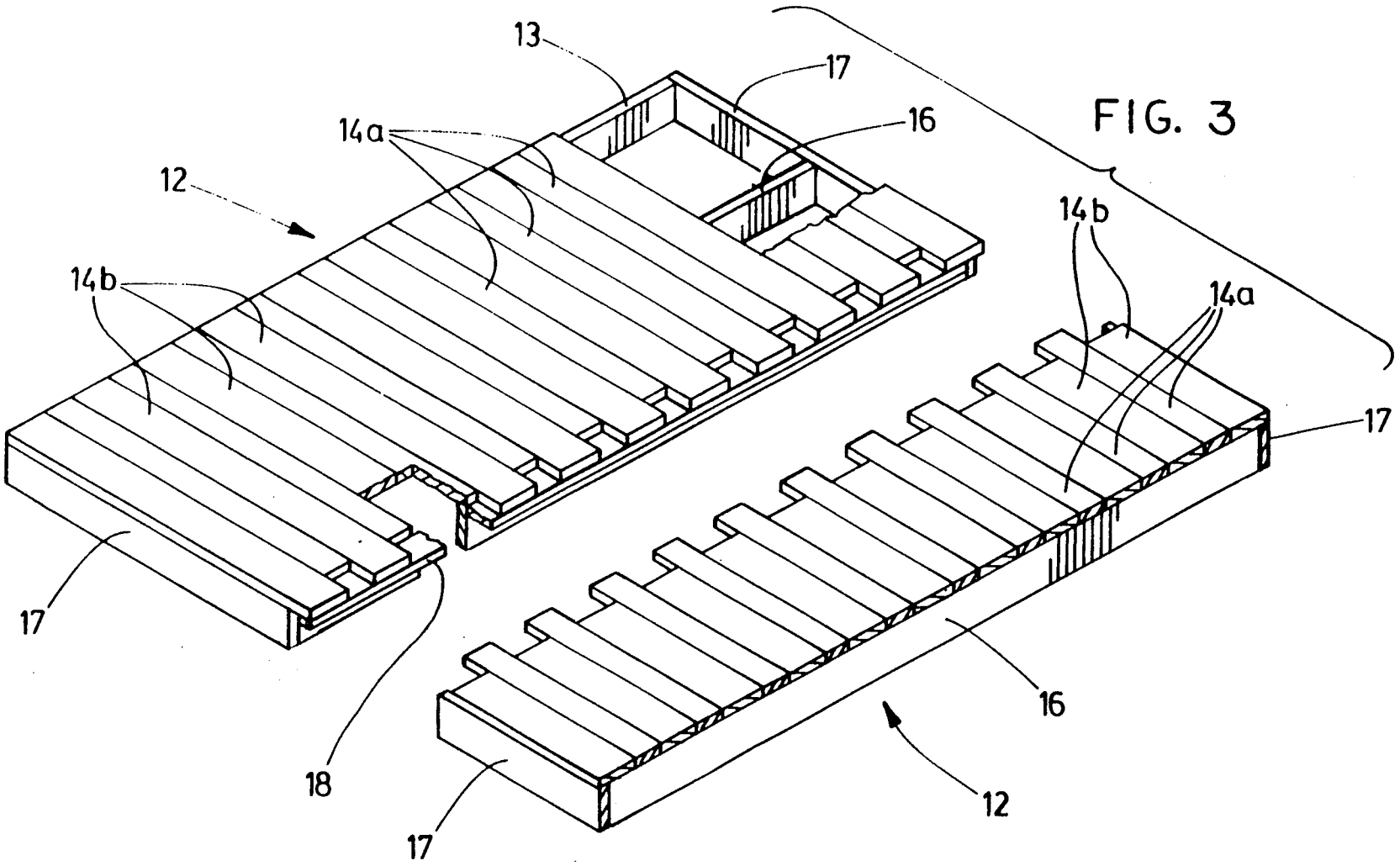
FIG. 3 is a partially exploded, partially cut away perspective view of the floor of FIG. 2.
Figure 4:
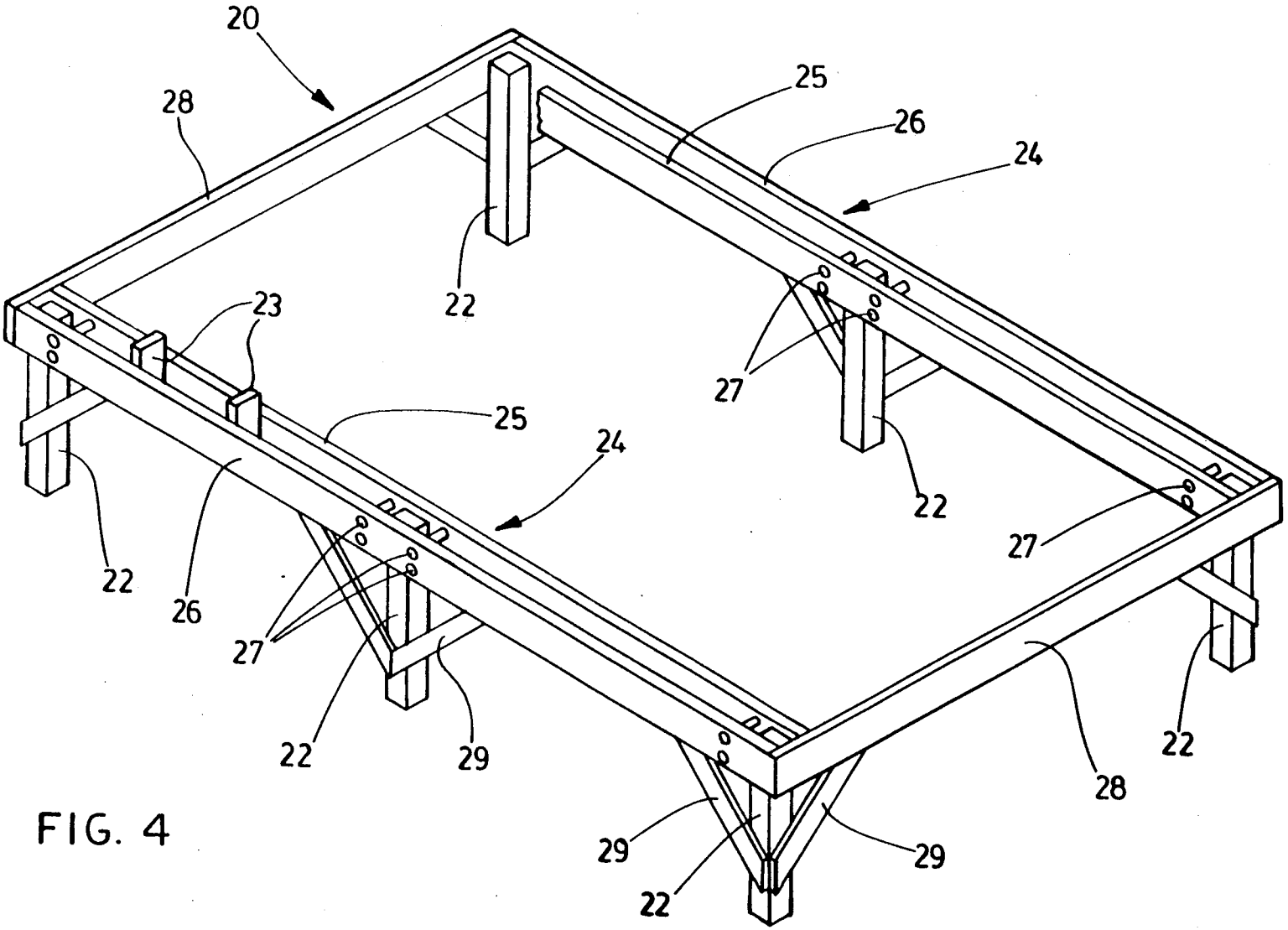
FIG. 4 is a perspective view of the supporting frame.

The floor 10 comprises modular sections 12, in the example illustrated each constructed from alternating 2×4 and 2×6 floor boards 14 secured to 2×6 joists 16 (illustrated in phantom in FIG. 2). To reduce inventory costs, it may be preferred to construct the floor sections 12 entirely from 2×6 boards. Alternate floor boards 14 include a portion **14*a* extending over any adjoining edge of a section 12, complimentary to extended portions 14*b* of alternate floor boards 14 in the next section 12 to which the first section will be affixed by means of a 2×4 joining board 18 secured to the extension portions 14*a*,14*b* of the floor boards 14. Extended ends are omitted along peripheral side edges, as at 13. Ribbon boards 17 are secured to the ends of the supporting joists 16**.

Figure 7:
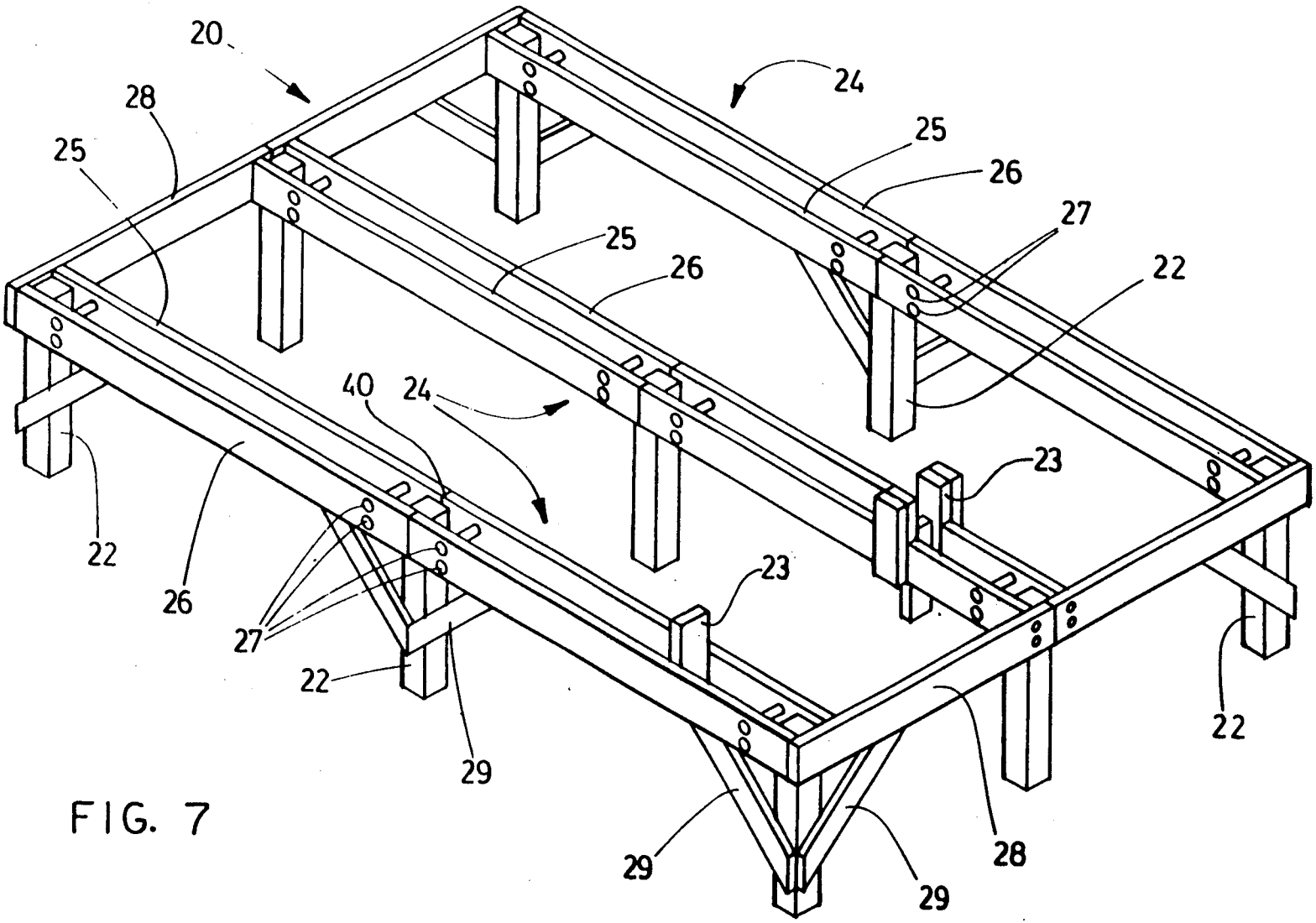
FIG. 7 is a perspective view of a modification of the supporting frame.

It will be apparent that any number of floor sections 12 may be joined side-to-side in this fashion, or front to back so long as a beam 24 as described below is provided at the front and rear of each floor section, as illustrated in FIG. 7. The size of the deck floor 10 is limited only by the available space and the size of the selected supporting frame 20. It will also be apparent that although the illustrated embodiment shows alternating 2×4 and 2×6 floor boards, any size of lumber that is suitably strong can be used for the floor boards 14 and joists 16.

The supporting frame 20 comprises 4×4 supporting legs 22 extending into front and rear beams 24. Each beam 24 comprises a pair of 2×6 or 2×8 boards 25,26 secured together by floor retaining posts 23 extending upwardly from the beams 24 as illustrated, which serve to retain the floor sections 12 on the frame 20. The retaining posts 23 should extend to just below the underside of the floorboards 14 for fastening the floor sections 10 to the retaining posts 23 from above. The ends of only one of the boards 26 of each beam 24 are secured to ribbon boards 28 of like dimensions. For reasons described below, one of the boards 25 of each beam 24 is left unsecured and bolts 27 are located closely adjacent to each leg 22.

Figure 5:
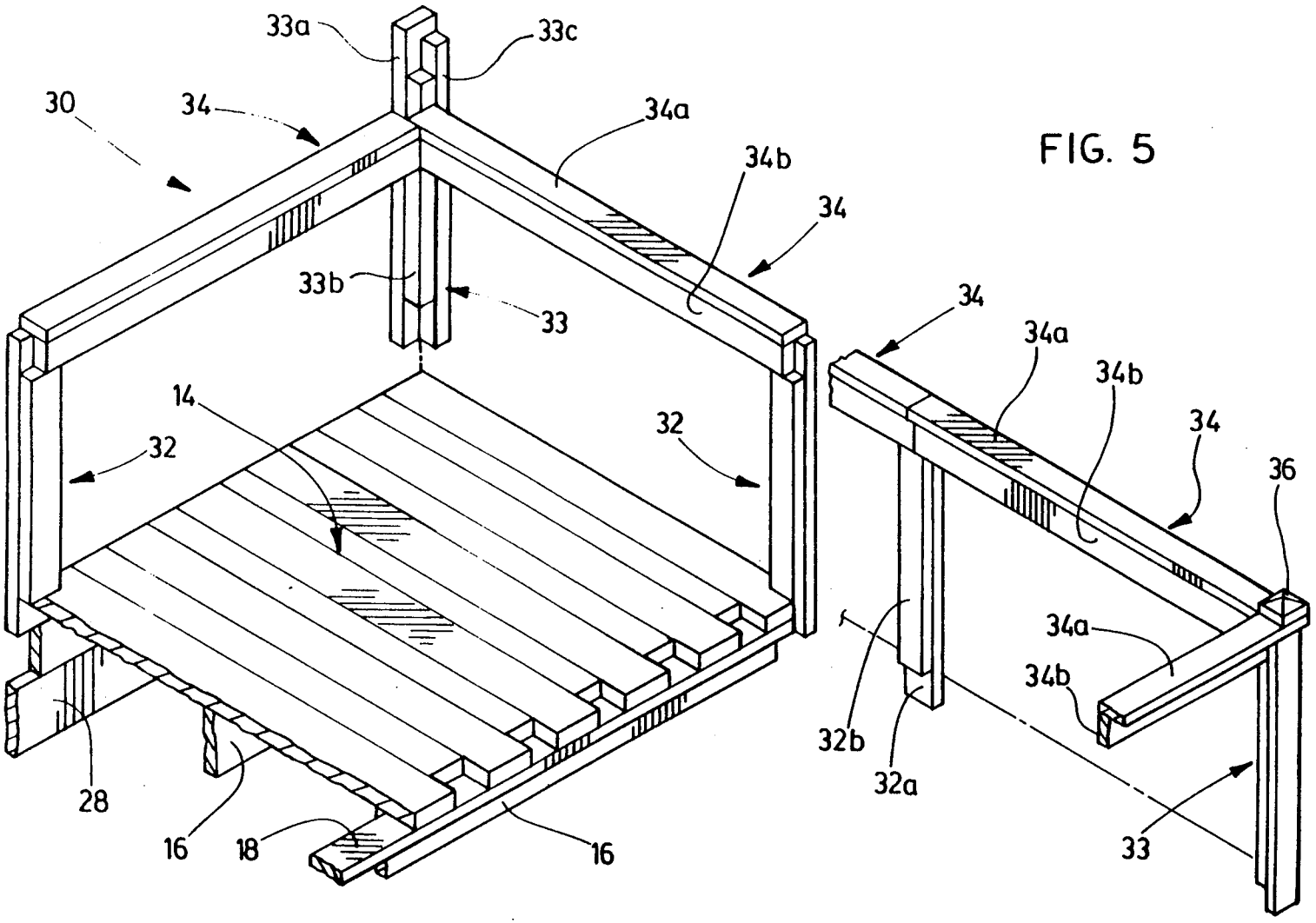
FIG. 5 is a perspective view of a preferred form of railing for the deck of the present invention.
Figure 6:
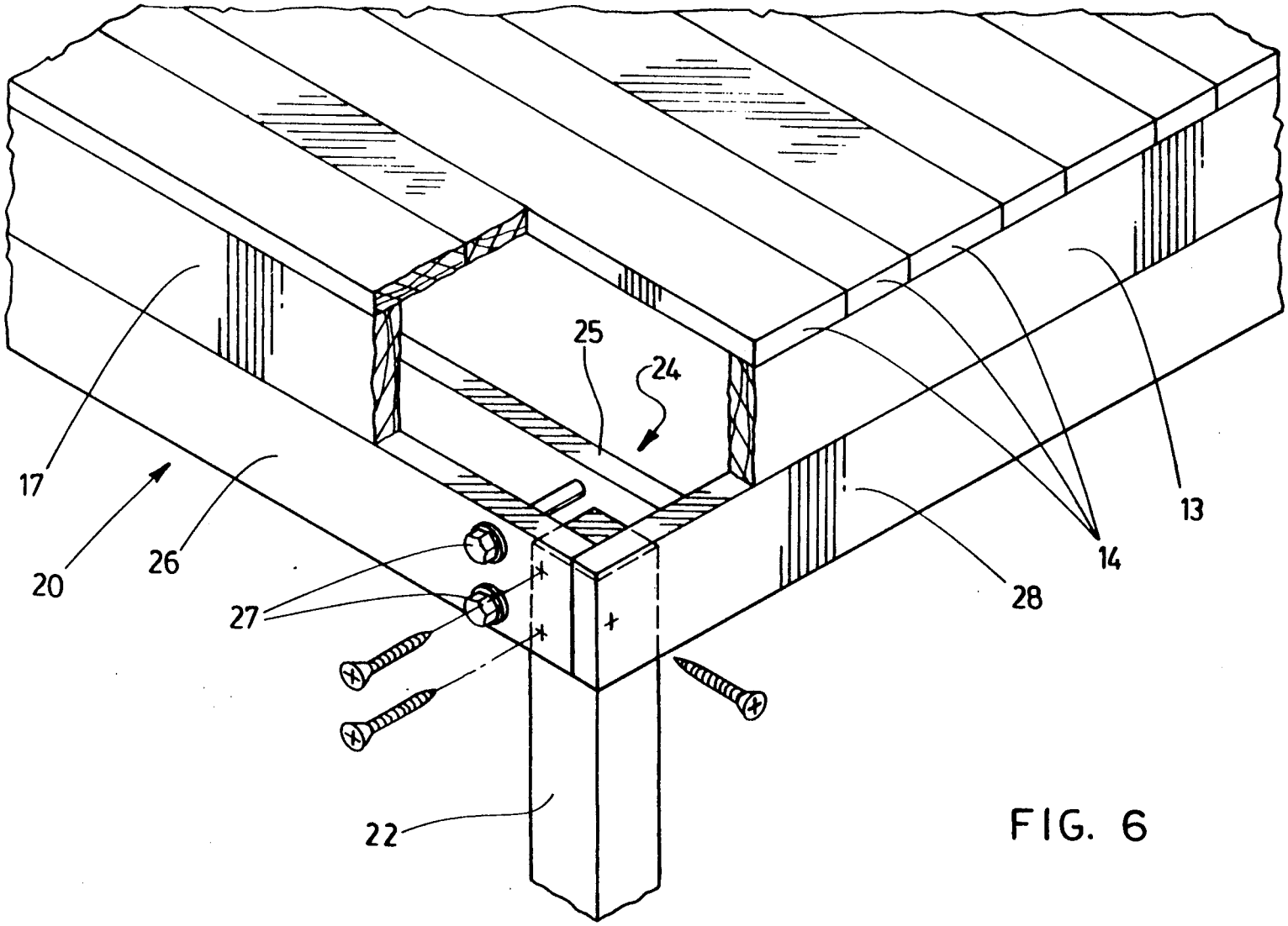
FIG. 6 is a perspective view of one corner of the frame of FIG. 4 illustrating the levelling feature.

The railing 30 comprises posts 32 and corner posts 33 supporting top rail sections 34, all constructed from 2×4 lumber. Preferably each post 32 comprises a long section 32*a* to which is affixed a shorter section 32*b* in the manner illustrated in FIG. 5. Corner posts 33 may be produced from a 2×4 33*a* to which are affixed short sections of 2×2 33*b*, 33*c*, the latter extending to the bottom of the post 33 to provide a finished appearance. The top rail sections 34 comprise a rail head 34*a* secured orthogonally to a supporting rail 34*b*. Thus, the top rail section 34 is secured at each end to the top of a post 32 with the rail head 34*a* seated on top of the long section 32*a* and the supporting rail 34*b* seated on top of the short section 32*b*, providing solid support with no gaps. The bottom of each post 32 is secured to the deck floor sections 12, with the bottom end of the short section 32*b* seated on top of the deck floor 10 and the bottom end of the long section 32*a* extending over a portion of the ribbon 17 or joist 16, depending on the location of the post 32.

The top rail sections 34 are preferably prefabricated in 4 foot lengths, and the posts 32 are cut or pre-cut to length for the desired height of the railing 30 in compliance with any applicable building code requirements. Railing sections 30 may be supplied pre-cut with a top rail section 34 presecured to a post 32 or corner post 33. A cap 36 may be used to finish off the outside corner gap between top rail sections 34 abutting at a corner post.

To erect the deck of the present invention, an end of each leg 22 is inserted between the board 25,26 of the beam, and the bolts 27 are tightened until the legs are frictionally engaged, but not locked in place, between the boards 25,26. The ribbon boards 28 are then secured to the ends of one of the two boards 25,26 of each beam, so that the frame 20 stands upright in the desired position. The bottoms of the legs 22 may rest on the ground, or preferably on a patio stone or the like to keep ground moisture away from the legs 22.

The frame 20 is then levelled by applying force, for example using a mallet, to raise or lower the beam 24 to the appropriate position relative to each leg 22. The bolts 27 are tight enough to cause the beam 24 to engage the legs 22, but sufficient force to overcome the frictional resistance (the amount depending on the tightness of the bolts 27) permits some slippage between the legs 22 and the beam 24, allowing the height of each leg 22 to be adjusted as required for levelling. When the beams 24 are properly levelled, screws or other preferably removable securing means are driven through the boards 25,26 into each leg 22. If the bolts 27 are properly tightened, the frame 20 will support itself through the levelling process, such that levelling can be accomplished by a single person. It is possible to secure one corner leg 22 to the beam 24 and to adjust all other legs 22 to the level of the secured leg, but it is preferable to have all legs 22 adjustable as described herein.

This levelling feature is the reason that only one of the boards 25, 26 of each beam 24 is initially secured to the ribbon boards 28, so space between the boards 25, 26 of the beam 24 can be adjusted as required for levelling. For the same reason, the retaining posts 23 must not be located too close to the supporting posts 22, or the retaining posts 23 could prevent the proper adjustment to the boards 25, 26 for levelling. Once the frame 20 has been levelled, struts 29 may be added as desired/for lateral support.

The ribbon boards may at this stage be fastened to the unfastened board 26 of each beam 24. The floor sections 12 are then seated on the frame 20, with the floor retaining posts 23 abutting the inner face of ribbon boards 17. The floor sections 12 may be secured to the posts 23 through the ribbon board 17, if accessible, or through the floor boards 14. The tops of the legs 22 may protrude from the top of the beam 24 so long as the legs 22 do not interfere with the seating of the floor sections 12.

Although in the embodiment illustrated the retaining posts 23 are shown immediately adjacent to the front and, rear edges of the floor section 12, it will be apparent that the floor 10 of the deck can be cantilevered by reducing the front-to-back dimensions of the frame 20 and securing a cross-brace between the joists 16 set back from the edge of each floor section 12 a corresponding distance, to abut the retaining post 23. It will also be apparent that the deck floor 10 may in some cases be secured at the rear to the main dwelling structure, in which case only one beam 24, located adjacent (either immediately adjacent or set back as described above) to the front of the floor 10, is required. In the preferred embodiment, however, at least two beams 24 are used as described above.

Finally, the rail sections 30 are secured to the floor sections 12, or, if not preassembled, posts 32 and corner posts 33 are secured to the floor sections 12 as described above, and the top rail sections 34 are secured to the tops of the posts 32, 33. Allowances may be made in the railing for stairs or other access points by placing the posts 32 as required and cutting the top rail sections 34 accordingly. Ballusters (not shown) may be secured as desired.

The deck may be extended forward indefinitely by adding beams 24 as required, as shown in FIG. 7. Moreover, the deck may be extended on either side by abutting beams 24 meeting at the centreline of a common leg 22, as at 40 in FIG. 7. In this fashion a modular sun deck of any dimension may be constructed from the basic components described above.

It will be apparent that the deck of the present invention is easily assembled, disassembled and reassembled as necessary, and being modular in nature is easy to transport from one location to another. Moreover, the deck is readily re-levelled from year to year or as required, by removing any struts, removing the screws joining the beam 24 to the tops of the legs 22, levelling the frame 20 as described above (care being taken to prop up the frame 20 if the floor sections 12 have not been removed prior to levelling) and driving the screws back through the beam 24 into each leg 22 in its new level position.

The invention having thus been described with reference to a preferred embodiment only, it will be obvious to those skilled in the art that certain adaptations and modifications may be made without departing from the scope of the invention as set out in the appended claims.

We claim:

1. A deck structure comprising:

a floor comprising at least one floor section, having floorboards, secured to orthogonal joists, and a supporting frame including legs supporting a beam, the beam comprising a pair of opposed boards with an adjustable gap therebetween and the legs having an upper portion of substantially uniform thickness, and securing means or adjusting the gap between the opposed boards extending through the beam adjacent to at least one leg, whereby the upper portion of at least one leg may be slidably engaged between the opposed boards such that when the securing means is tightened the leg is frictionally engaged between the opposed boards so that the frame is temporarily supported on the leg and the beam may be moved relative to the leg by sufficient force to overcome the frictional engagement thereof.

2. The deck of claim 1 in which the securing means extends through the opposed boards of the beam adjacent to said at least one leg.

3. The deck of claim 2 in which including alternate floor boards which extend beyond an edge of the floor section for interlocking fit with a next adjacent floor section.

4. The deck of claim 2 in which the securing means are provided adjacent to each leg.

5. The deck of claim 4 in which the supporting frame includes more than one beam.

6. The deck of claim 5 including a railing.

7. A frame for a deck structure comprising:

supporting legs each having an upper portion of substantially uniform thickness, and a supporting beam comprising a pair of opposed boards connected by securing means with a gap between the boards sufficient to enable the upper portions of the legs to be disposed therein, The securing means being operable to be tightened such that the leg disposed in the gaps adjacent to the securing means is frictionally engaged between the boards and thereby temporarily supports the frame, and a height of the beam relative to the leg can be adjusted by the application of force sufficient to overcome the frictional engagement of the leg by the beam.

8. The frame of claim 7 wherein the securing means comprise bolts.

9. The frame of claim 7, wherein the frame is rectangular and includes including a pair of supporting beams disposed along opposite sides of the frame.

10. The frame of claim 9 including a ribbon board securing an end of one beam to an end of the other beam.

11. The frame of claim 7 including means or retaining a floor section extending upwardly from the beam.

* * * * *